United States Patent [19]

Pieczykolan

[11] Patent Number: 4,553,602

[45] Date of Patent: Nov. 19, 1985

[54] AUTOMATIC ON-OFF SPRINKLER HEAD

[76] Inventor: George S. Pieczykolan, c/o Central Sprinkler Corp., Fourth St. and Cannon Ave., Lansdale, Pa. 19446

[21] Appl. No.: 455,860

[22] Filed: Jan. 5, 1983

Related U.S. Application Data

[63] Continuation-in-part of Ser. No. 289,451, Aug. 3, 1981, abandoned, which is a continuation-in-part of Ser. No. 250,097, Apr. 11, 1981, abandoned.

[51] Int. Cl.[4] ..... A62C 37/20

[52] U.S. Cl. ..... 169/19; 169/90

[58] Field of Search ..... 169/37, 19, 57, 90

[56] References Cited

U.S. PATENT DOCUMENTS

| | | | |
|---|---|---|---|
| 2,026,916 | 1/1936 | Smith | 251/46 |
| 2,414,127 | 1/1947 | Shaw | 169/38 |
| 2,786,642 | 3/1957 | Comb . | |
| 3,757,866 | 9/1973 | Mears et al. | 169/37 |
| 3,812,914 | 5/1974 | Mears . | |
| 3,848,676 | 11/1974 | Doherty, Jr. | 169/37 |
| 3,924,687 | 12/1975 | Groos | 169/19 |
| 4,128,128 | 12/1978 | Mears . | |
| 4,139,062 | 2/1979 | Rago | 169/37 |
| 4,368,782 | 1/1983 | Bray | 169/90 |

*Primary Examiner*—Andres Kashnikow

*Attorney, Agent, or Firm*—Seidel, Gonda, Goldhammer & Abbott

[57] ABSTRACT

An automatic on-off sprinkler head is disclosed for discharge of water for extinguishing a fire in the vicinity in which the delivery of water to and through the head is controlled by alternative temperature responsive elements, namely a snap-disc and a fusible alloy, which normally remains in an inactive position, the temperature responsive element actuating a seal plunger to retain water in a priming or control chamber, the priming or control chamber having therein a flexible tubular valve capable of being compressed to and retained in a closed position by the pressure in the priming or control chamber, the flexible tubular valve providing a boundary of the priming or control chamber, the flexible tubular valve providing a passageway connecting the inlet of the sprinkler head with the discharge orifice nozzle for straight through flow when the flexible tubular valve is in uncompressed or open condition, the priming or control chamber being in communication with the inlet for pressure variation accommodation, the flexible tubular valve being clamped at its upper and lower ends for retention in the head, the seal plunger venting the priming or control chamber upon actuation of the temperature responsive element, the seal plunger normally retaining the flexible tubular valve in closed position to prevent flow of water and retaining deposit buildup at the upper end of the flexible tubular valve, but opening for discharge of water and flushing of deposit buildup, the venting being discontinued and the valve being closed upon lowering of the ambient temperature, the sprinkler head acting to conserve water and to reduce water damage by avoiding unnecessary discharge of water.

6 Claims, 10 Drawing Figures

10
14
11
16
15
31
20
32
22

37
33
30
30a
44
36
38a
35
38
40
12
66
66
39
18
5
5
43
50
39
41
23
45
43a
42
28
21
13
76
52
74
72
75
51
82
69
70
71
71
77
73
80
78
79
79
78
80
79
91
90
79

FIG. 5
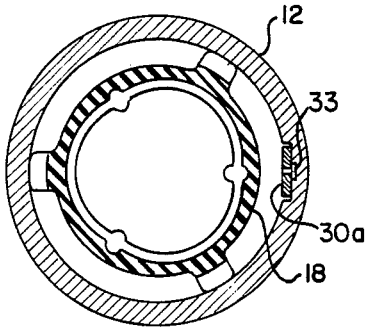
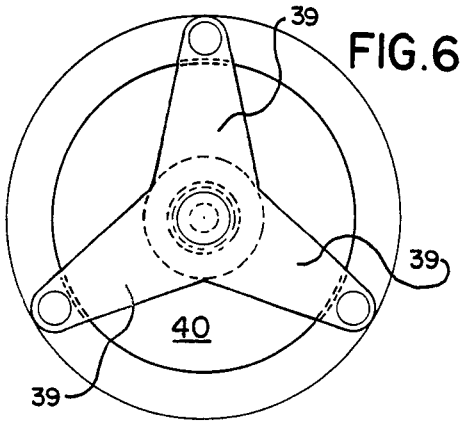
FIG. 6
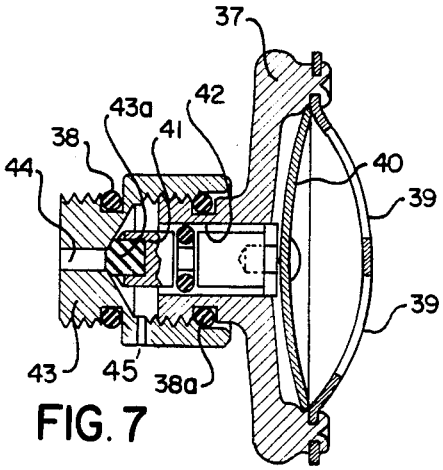
FIG. 7
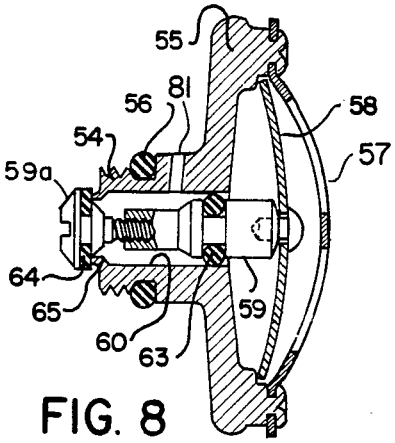
FIG. 8
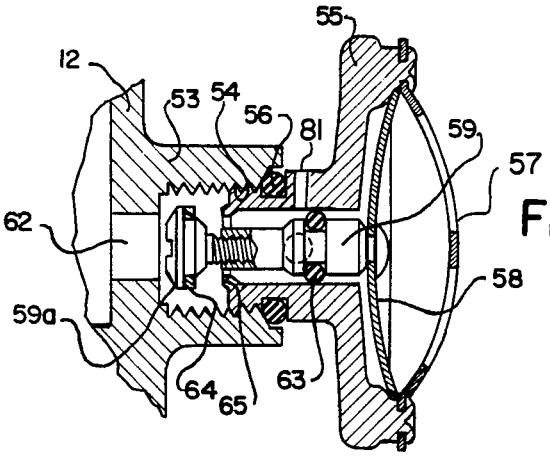
FIG. 9

AUTOMATIC ON-OFF SPRINKLER HEAD

CROSS REFERENCE TO RELATED APPLICATIONS

This application is a continuation-in-part of my prior application for Automatic On-Off Sprinkler Head, filed Aug. 3, 1981, Ser. No. 289,451, which is in turn a continuation in part of my prior application for Automatic On-Off Sprinkler Head, filed Apr. 11, 1981, Ser. No. 250,097. Both applications are now abandoned.

BACKGROUND OF THE INVENTION

1. Field of the Invention

This invention relates to on-off sprinkler heads and, more particularly, to such a sprinkler head which is controlled by a temperature responsive element, such as a snap disc or a fusible alloy.

2. Description of the Prior Art

It has heretofore been proposed as shown in the patents to Mears, U.S. Pat. Nos. 3,757,866 and 3,812,914, to employ piston controlled valves which are controlled by pilot valves actuated by bimetallic temperature responsive discs, but these have not proven wholly satisfactory in use, because the contamination level to critical internal components can cause buildup of mineral and sludge deposits and thus, with a circuitous flow, as in U.S. Pat. No. 3,757,866, have caused difficulties which cannot occur in the structure of the present invention.

Mears, in U.S. Pat. No. 4,128,128, shows a diaphragm actuated sprinkler head in which the diaphragm carries a hollow cylindrical valve which is movable upwardly against the downward force of a spring 52 and which is actuated upwardly by water pressure available through the branch water passageway 42 and control passageway 46, when the pilot valve of the pilot valve assembly 40 is opened by the bimetalic disc 62. This structure is subject to contamination and buildup of mineral and sludge deposits.

Smith, in U.S. Pat. No. 2,026,916, shows a toilet flush valve which includes a valve body having a resilient tube 50 within a sleeve 53 slotted at 54 and 54*a* to communicate with a chamber 11 between interior body portions 16 and 17. A restricted bypass 18 is provided through the body portion 16 for restricted delivery of liquid into the chamber 11, as controlled by the setting of the valve 20 with respect to the tube 19. The resilient tube 50 has a tube flange 52 which is held at the bottom by the sleeve 53 against a ring 55 which engages a shoulder 17*a*, and at the top has a flange 51 which is held against the sleeve by a ring 60 threaded into a coupling 61 which is in turn threaded into the body portion 16. The tube 50 is normally held in closed position as shown in FIGS. 3 and 5, and in order to relieve the pressure in the chamber 11 and effective through the slots 54 and 54*a* on the exterior of the tube 50, a handle 41 on a rod 33 is provided for movement of a valve plug 30 from its seat 31 for discharge of liquid from the chamber 11 through a restricted opening 25 and a port 32 into the outlet passage 12. When the valve plug 30 returns to its seat, the pressure will build up and shut off flow through the tube 50. The Smith structure is complicated to assemble, has fluctuations in the system, does not have any response to excessive temperatures, and lacks the molded valve of applicant.

Comb, in U.S. Pat. No. 2,786,642, shows in FIGS. 1, 2 and 3, a pilot controlled hollow flexible or resilient tubular valve member 7 which engages a central rod 19 disposed between the inlet openings 15 at ingress port 3 in a sealing ring plate 16 and outlet opening 17 at egress port 5 in a sealing ring plate 18. The valve member 7 is described as located within pipe 1 and attached thereto by means of sealing rings 9 and 11. The pipe section 1 bounds, with the valve member 7, a fluid tight chamber 13 to which fluid is accessible at the ingress end through a conduit 23, the conduit 23 at the egress end being controlled by a valve 24 which has a plunger 25 actuated by a solenoid 27. When the valve 23 is open by actuation of the solenoid 27, fluid may flow to the egress port of the pipe to drop the pressure in the chamber 13 so that the tubular valve member 7 assumes a tubular shape permitting flow.

The other forms of the Comb disclosure in FIGS. 4 to 10, inclusive, are not relevant to the present invention.

Applicant has provided a positive attachment for the ends of the tubular valve member to overcome problems which may arise if the structure is inactive for a long period of time, and there is no suggestion in Comb of any temperature responsive control which is particularly suitable for reducing water damage by a sprinkler, nor of a compact temperature controlled valve of the character disclosed.

SUMMARY OF THE INVENTION

In accordance with the invention, an automatic on-off sprinkler head is provided in which the delivery of the water to and through the head is controlled by a fusible alloy ring-plunger assembly temperature responsive element which normally remains in an inactive position, the temperature responsive element actuating a seal plunger to release water in a priming or control chamber, the chamber having therein a flexible tubular valve capable of being compressed to a closed position by the pressure in the control chamber, the tubular valve being disposed in a passageway connecting the inlet and the discharge orifice nozzle for straight through flow in uncompressed condition, the control chamber being in communication with the passageway outside the flexible tubular valve, the tubular valve being securely clamped at its upper and lower ends for retention in the head, the seal plunger vents the control chamber, the venting being accomplished by the use of a teflon rod inserted in the tubular valve or diaphragm for the purpose of sprinkler system pressure equalization on the inlet-outlet-priming chamber side walls of the above mentioned valve, thus eliminating any stress or compression set on same, due to system pressure fluctuations, since they will be equally dissipated throughout the inlet-outlet-priming chamber cavities as long as the fusible alloy-plunger-balls assembly is intact. The rod will self-eject on the initial flow-through cycle.

In accordance with the invention, an on-off sprinkler head is provided in a housing in which the water flow is retained by a fusible alloy ring-plunger assembly and in which a tubular valve is normally held in neutral position by pressure applied thereon from a priming or control chamber thereareound, which pressure is varied with the supply pressure, and from which the pressure is relieved by operation of a valve member when a predetermined ambient temperature is attained by operation of a temperature responsive element, such as a bimetallic disc, and which valve member will be closed when the ambient temperature falls, thereby reducing waste of water and excessive water damage.

It is the principal object of the invention to provide an improved sprinkler head of the on-off type so that when the ambient temperature at a temperature responsive element is reduced, the flow is shut off, thereby reducing waste of water and excessive water damage.

It is a further object of the invention to provide an improved sprinkler head of the on-off type in which a teflon rod is incorporated in the tubular valve or diaphragm for the purpose of sprinkler system pressure equalization on the inlet-outlet-priming chamber side walls of the above mentioned valve, thus eliminating any stress or compression set on same, due to system pressure fluctuations, since they will be equally dissipated throughout the inlet-outlet-priming chamber cavities as long as the fusible-alloy-plunger-balls assembly is intact, the splint being self-ejecting on the initial flow-through cycle.

It is a further object of the invention to provide an improved sprinkler head of the on-off type in which a better flow of liquid is attained when the sprinkler is in operation.

It is a further object of the invention to provide an automatic on-off sprinkler head in which the contamination level effective on the internal components is retained at a predetermined location, thereby improving the performance of the sprinkler head.

It is a further object of the invention to provide an automatic on-off sprinkler head in which a fusible alloy ring is provided located within a sleeve and insulated from the plunger by a phenolic insulator ring to prevent "cold flow", i.e. the transfer of heat through adjoining surfaces of materials possessing high conductivity factors, thus providing a more responsive sprinkler head.

It is a further object of the invention to provide an automatic on-off sprinkler head in which the pressure in the control chamber is regulated by a restriction orifice communicating with the control chamber which compensates for sprinkler head pressure variations.

Other objects and advantageous features of the invention will be apparent from the description and claims.

BRIEF DESCRIPTION OF THE DRAWINGS

The nature and characteristic features of the invention will be more readily understood from the following description taken in conjunction with the accompanying drawings forming part hereof in which:

FIG. 5 is a horizontal sectional view taken approximately on the line 5—5 of FIG. 4;

FIG. 6 is a side elevational view of a snap-disc element taken on the line 6—6 of FIG. 1;

FIG. 7 is a vertical sectional view of a snap-disc module in a primed or closed mode;

FIG. 8 is a vertical sectional view of a snap-disc module of FIG. 7 in a primed or closed mode;

FIG. 9 is a vertical sectional view of a modified form of the snap-disc module of FIG. 8 in an activated mode.

Figure 1:
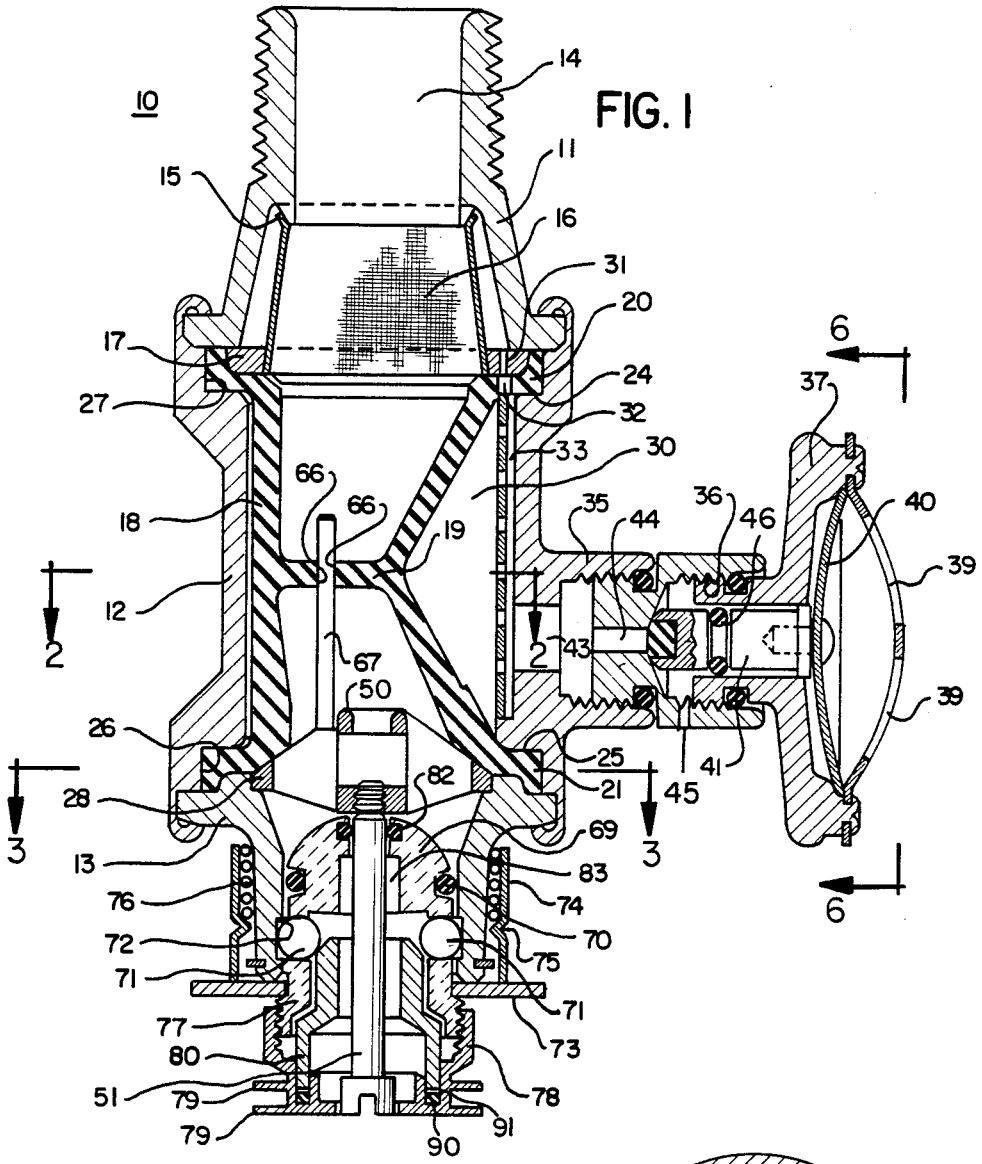
FIG. 1 is a vertical central sectional view of a sprinkler head in accordance with the invention and with the flow shut off.
Figure 3:
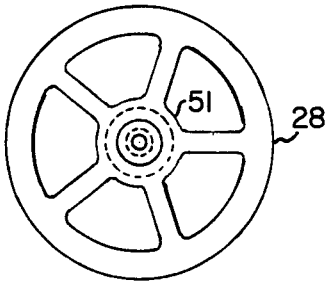
FIG. 3 is a partial horizontal sectional view taken approximately on the line 3—3 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the sprinkler head 10 in accordance with the invention has an upper housing section 11, an intermediate or main housing section 12 and a lower housing section 13, secured together in any desired manner.

The upper housing section 11 has an inlet orifice or opening 14 for the connection of a supply pipe (not shown) to supply water to the sprinkler head 10.

The upper housing section 11 has a groove 15 for the reception of the upper end of a filter screen 16 which is held at its lower end in a washer 17 of metal or the like.

A flexible tubular valve or diaphragm 18 is provided having a central portion 19 of converging and diverging shapes with outwardly extending upper and lower flanges 20 and 21, and is preferably molded of rubber or the like to obtain the desired shape.

The main housing section 12 has upper and lower horizontal shoulders 24 and 25 for engagement by the flanges 20 and 21 and the main housing section 12 has grooves 26 and 27 for the reception of the rims 22 and 23.

The tubular valve or diaphragm 18 is spaced from the inner face of the main housing section 12 to provide a priming or control chamber 30.

The lower flange 21 and the lower rim 23 have a spider flange 28 in engagement therewith to aid in retaining them in place.

The upper washer 17 has an orifice or restriction 31 therethrough aligned with an opening 32 in the upper flange 20 for access of fluid from the inlet opening 14, through the restriction 31 and opening 32 to the chamber 30. A groove 33 is provided downwardly along the inner face of the main housing 12 and a perforated plate **30*a* extends downwardly spaced from the groove 33. The section 11, an intermediate or main housing section 12 and a lower housing section 13** are secured together in any desired manner.

The main housing section 12 has a boss 35 extending therefrom and has threaded thereinto at 36 a support 37 with interposed seals 38 and **38*a*. The support 37 has a plurality of arms 39 which support a temperature responsive bimetallic snap-disc 40. The snap-disc 40 has a seal plunger 41 secured thereto and slidable in an opening 42 in the support 37. Plunger 41 has a seal 43*a* for closing a discharge port 44 communicating with the groove 33. Plunger 41 is movable by the snap disc 40 to a closed position with respect to the port 44 thereby preventing access of liquid to a discharge port 45 in the boss 35 or to an open position permitting fluid delivery through the discharge port 45. The plunger 41 has a seal 46** for preventing leakage of fluid.

The lower housing section 13 has a spider 50 therein connected to the spider flange 28 and which supports a stem 51 extending downwardly through a fluid discharge port 52, which is aligned with the inlet opening 14.

The lower housing section 13 has a fluid discharge port 52 within which a valve plug 69 is disposed, the valve plug 69 having a sealing ring 70, and with locking balls 71 carried in a groove 72 in the lower housing section 13. A water distributing plate 73 is provided with a cylindrical sleeve 74 in surrounding relation to the lower housing section 13. The sleeve 74 has an inwardly extending rim 75 with a spring 76 disposed thereabove. The distributing plate 73 has an externally threaded collar 77 secured thereto with which a sleeve 78 is in threaded engagement, the sleeve 78 has a pair of circular fins 79 secured thereto with an internal plunger 80 which is movable downwardly to release the locking balls 71. A fusible alloy ring 90 is located inside sleeve 78, and is insulated from the plunger 80 by an phenolic insulator ring 91. A stem 51 is in the threaded engagement with the central portion of the spider 50 and a sealing ring 82 in engagement with the valve plug 69 and with the stem 51 prevents fluid leakage at this location. The valve plug 69 has a recess 83 for the reception of the head of the stem 51.

An alternative construction of snap-disc construction is shown in FIGS. 8 and 9, and includes a boss 53 extending from the intermediate housing section 12 and has threaded thereinto at 54 a support 55 with an interposed packing 56. The support 55 has a plurality of arms 57 which support a temperature responsive bimetallic snap-disc 58. The snap-disc 58 has a seal plunger 59 secured thereto slidable in an opening 60 in the support 55, has a seal 64 carried thereon for closing a discharge port 62. The plunger 59 has a packing ring 63 thereon to prevent fluid leakage and has a sealing ring 64 carried thereon for engagement with a rim 65 to prevent fluid leakage. The head **59*a* of the seal plunger 59 is adjustable to compensate for variation of plunger 59 and snap-disc 58 length variation. The interior of the tubular valve 18, preferably intermediate its ends, is provided with a plurality of pairs of mating projections 66** to facilitate sealing the tubular valve in its closed position.

The mode of operation will now be pointed out.

When the ambient temperature at the location of the sprinkler head 10 reaches the predetermined set value, say 135° F., the fusible alloy 90 melts, permitting the plunger 80 to drop downwards, which permits the balls 71, located in the ball retaining groove to clear the groove 72 which in turn allows the whole plunger housing and deflector assembly to slide down the stem 51 to a predetermined elevation, at the same time the bimetallic snap-disc 40 will move the seal plunger 41 outwardly or plunger 59 inwardly so that the seal **43*a* or 64 is positioned away from the discharge port 44 or 62, water will be discharged from the control chamber 30 through the discharge port 44 or 62 and the discharge port 45 or 81 to remove the pressure in the chamber 30 applied on the tubular valve 18**.

Figures 4, 10:
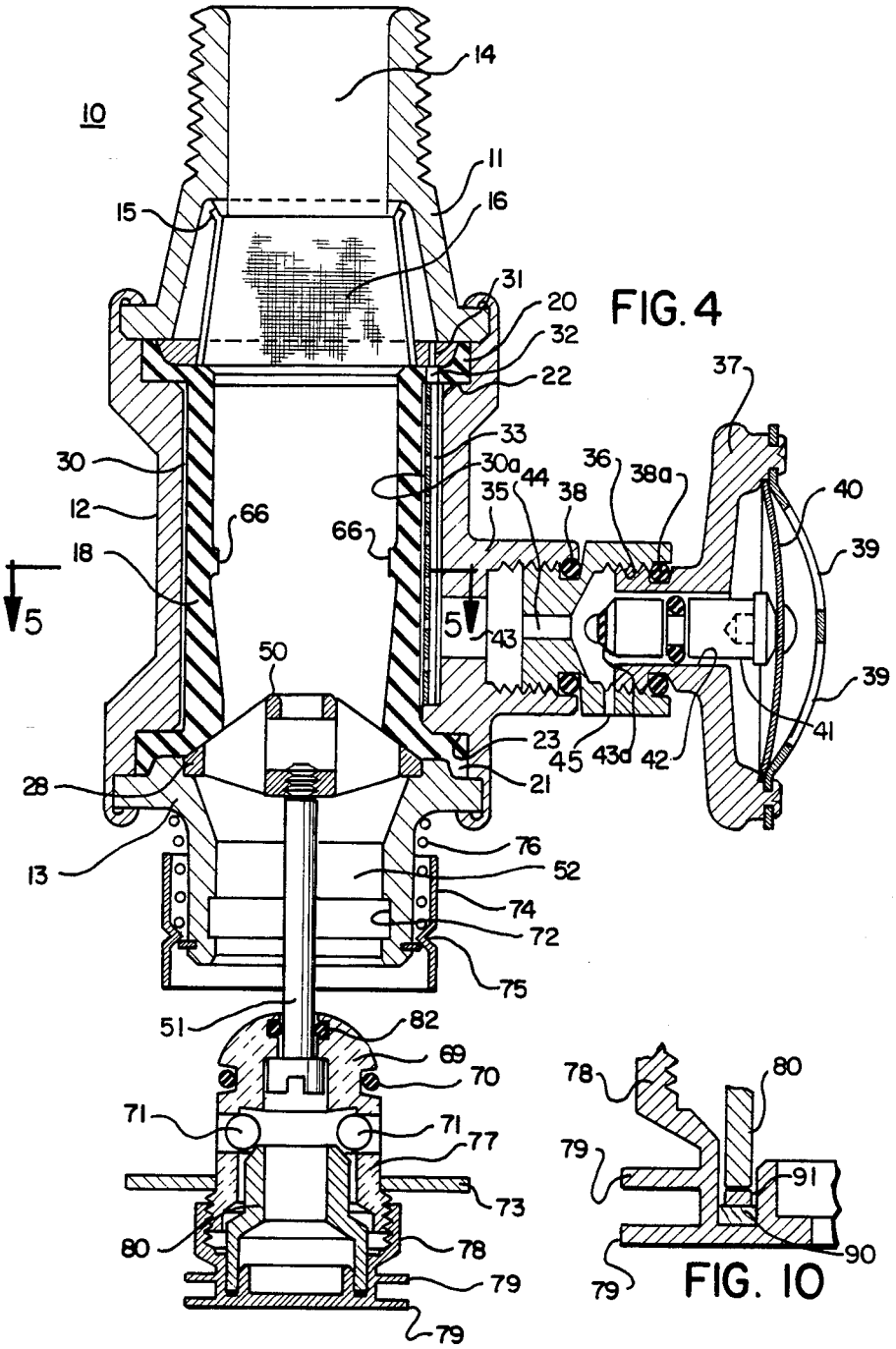
FIG. 4 is a vertical central sectional view of the sprinkler head of FIG. 1 in an open position for flow.
FIG. 10 is an enlarged vertical sectional view of the fusible alloy ring assembly in the primed mode.

The removal of pressure applied in the chamber 30 on the outside of the tubular valve 18 will permit the valve 18 to move to an open position as shown in FIG. 4, so that water is delivered from the inlet opening 14 to the discharge port 52 where it strikes the deflector plate 53 and is distributed over the area below.

If the ambient temperature effective at the disc 40 or 58 falls so that the disc 40 or 58 snaps to move the seal plunger 41 or 59 to close and seal off the discharge port 44 or 62.

Figure 2:
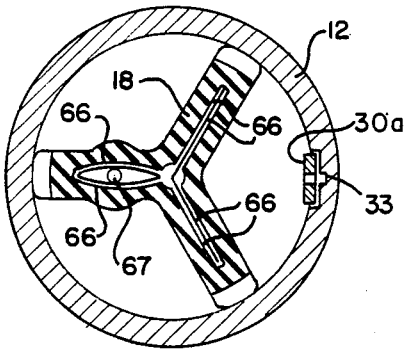
FIG. 2 is a horizontal sectional view taken approximately on the line 2—2 of FIG. 1.

Fluid will enter through the orifice 31 and pressure will build up in the control chamber 30 so that the valve member 18 is moved to a closed position as shown in FIGS. 1 and 2 to shut off the flow through the valve member 18. The rod 67 will have been ejected.

It will be noted that prior to venting of the control chamber 30, and if the seal plunger 41 or 59 is again moved to closed position, variations in pressure of the water in the upper housing section 11 and in the inlet connection 14 will be effective through the restriction or orifice 31 for equalization of the pressure at the supply connection 14 and in the control chamber 30, thus reducing unnecessary and wasteful delivery of water.

The removal of pressure applied in the chamber 30 on the outside of the tubular valve 18 will permit the valve member 18 to move to an open position as shown in FIGS. 9 and 10, so that water is delivered from the inlet opening 14 to the discharge port 52 where it strikes the deflector plate 73 and is distributed over the area below.

The present invention may be embodied in other specific forms without departing from the spirit or essential attributes thereof and, accordingly, reference should be made to the appended claims, rather than to the foregoing specification, as indicating the scope of the invention.

As shown in FIGS. 1 and 10, an insulator ring 91 is provided with a fusible alloy ring 90 thereabove.

I claim:

1. A sprinkler head for automatic sprinkler systems comprising a housing having a fluid inlet and a fluid outlet communicating with a chamber therebetween, a fluid responsive valve member within said chamber and biased to a closed position by fluid pressure from said inlet, a downstream surface of said valve member being in fluid communication with said outlet, means for equalizing fluid pressure upstream and downstream of said valve member, valve means movably supported by said housing for controlling flow through said outlet, a first temperature responsive controller, said temperature responsive controller being connected to said movable valve means whereby the movable valve means moves to an open position when said temperature controller senses a predetermined temperature, said movable valve means supporting a fluid deflector and said temperature responsive controller for movement therewith, and a pilot valve for relieving the effective inlet pressure on a surface of said valve member to permit discharge through said outlet when said valve means is in its open position, said pilot valve being responsive to a second temperature responsive controller, said second temperature responsive controller being responsive to a higher temperature than said first temperature responsive controller.

2. A sprinkler head in accordance with claim 1 wherein said fluid inlet and fluid outlet are coaxial, said moveable valve means including a plunger coaxial with said inlet and outlet and moveable in an axial direction from a closed position to an open position.

3. A sprinkler head in accordance with claim 2 wherein said plunger is vertically disposed and moves downwardly from its closed position to its open position, said fluid deflector being above the elevation of said first temperature responsive controller.

4. A sprinkler head in accordance with claim 1 wherein said pilot valve is supported by a boss on said housing and includes a valve member moveable toward and away from said chamber by said second temperature responsive controller.

5. A sprinkler head for automatic sprinkler systems comprising a housing having a fluid inlet coaxial with and above the elevation of a discharge port, a flexible tubular valve member within said housing and in spaced relation thereto to provide between said valve member and said housing a control chamber, said valve member being between said inlet and said port, means within said flexible tubular valve member for equalizing pressure on opposite surfaces thereof, a plunger moveable in a vertical direction for controlling flow from said discharge port, said discharge port being closed in the uppermost position of said moveable plunger and being open in the lowermost position of said moveable plunger, a deflector for deflecting water discharged through said port, said deflector being connected to said plunger for movement therewith, temperature responsive means moveable with said plunger for initiating movement at said plunger from said closed position to said open position, and a temperature responsive pilot valve for controlling discharge from said control chamber to the exterior of said housing to thereby open said valve member after said plunger is in its lowermost position.

6. A sprinkler head for automatic sprinkler systems comprising a housing having a fluid inlet and a fluid outlet communicating with a chamber therebetween, said fluid inlet and fluid outlet being coaxial, a flexible tubular valve member within said chamber having interior ceiling projections carried thereby and biased to a closed position by fluid pressure from said inlet, a rod interiorly disposed within said flexible tubular valve member to prevent complete closure of the tubular valve member for equalizing fluid pressure upstream and downstream of said valve member, valve means movably supported by said housing for controlling flow through said outlet, a first temperature responsive controller, said temperature responsive controller being connected to said movable valve means whereby the movable valve means moves to an open position when said temperature controller senses a predetermined temperature, said movable valve means supporting a fluid deflector and said temperature responsive controller for movement therewith, said fluid deflector being above the elevation of said first temperature responsive controller, said movable valve means including a vertically-disposed plunger coaxial with said inlet and outlet and movable downwardly from the closed position to the open position, and a pilot valve supported by a boss on said housing for relieving the effective inlet pressure on a surface of said valve member to permit discharge through said outlet when said valve means is in its open position, said pilot valve being responsive to a second temperature responsive controller and including a valve member movable toward and away from said chamber by said second temperature responsive controller.

* * * * *